US008136926B2

(12) United States Patent
Kim et al.

(10) Patent No.: US 8,136,926 B2
(45) Date of Patent: Mar. 20, 2012

(54) INK-JET HEAD AND MANUFACTURING METHOD THEREOF

(75) Inventors: Boum-Seock Kim, Suwon-si (KR); Jae-Woo Joung, Suwon-si (KR); Ju-Hwan Yang, Suwon-si (KR); Young-Seuck Yoo, Seoul (KR)

(73) Assignee: Samsung Electro-Mechanics Co., Ltd., Gyunggi-do (KR)

( * ) Notice: Subject to any disclaimer, the term of this patent is extended or adjusted under 35 U.S.C. 154(b) by 169 days.

(21) Appl. No.: 12/541,609

(22) Filed: Aug. 14, 2009

(65) Prior Publication Data

US 2010/0141712 A1 Jun. 10, 2010

(30) Foreign Application Priority Data

Dec. 4, 2008 (KR) ..... 10-2008-0122621

(51) Int. Cl.
*B41J 2/045* (2006.01)

(52) U.S. Cl. ..... 347/68; 347/70

(58) Field of Classification Search ..... None
See application file for complete search history.

(56) References Cited

U.S. PATENT DOCUMENTS

2007/0120896 A1* 5/2007 Stephens et al. ..... 347/68
2008/0084458 A1* 4/2008 Sugahara ..... 347/70

FOREIGN PATENT DOCUMENTS

JP 02187352 A * 7/1990
JP 2006-076128 3/2006
KR 1999-004635 1/1999

OTHER PUBLICATIONS

Korean Office Action, w/ partial English translation thereof, issued in Korean Patent Application No. KR 10-2008-0122621 dated Dec. 30, 2010.

* cited by examiner

*Primary Examiner* — Matthew Luu
*Assistant Examiner* — Lisa M Solomon
(74) *Attorney, Agent, or Firm* — McDermott Will & Emery LLP

(57) ABSTRACT

Disclosed are an ink-jet head and a method of manufacturing the ink-jet head including a plurality of chambers, a membrane covering the plurality of chambers, and a plurality of actuators separated from one another by a virtual dividing line on the membrane such that pressure is applied to each of the plurality of chambers. The method in accordance with an embodiment of the present invention includes: forming a groove at a position on one surface of the membrane, the position corresponding to the position of the dividing line; bonding a piezoelectric member to the one surface of the membrane having the groove formed therein by using adhesive resin; and dividing the piezoelectric member such that the groove is exposed.

2 Claims, 6 Drawing Sheets

INK-JET HEAD AND MANUFACTURING METHOD THEREOF

CROSS-REFERENCE TO RELATED APPLICATIONS

This application claims the benefit of Korean Patent Application No. 10-2008-0122621, filed with the Korean Intellectual Property Office on Dec. 4, 2008, the disclosure of which is incorporated herein by reference in its entirety.

BACKGROUND

1. Technical Field

The present invention relates to an ink-jet head and a manufacturing method thereof.

2. Description of the Related Art

The ink-jet printer can perform printing by converting an electrical signal into a physical force and ejecting ink droplets through a nozzle. The ink-jet head can be manufactured by processing various components such as a chamber, a restrictor, a nozzle, a piezoelectric member, etc., on each corresponding layer and bonding the layers together.

Recently, the ink-jet head is increasingly used not only in the conventional graphic ink-jet industry for printing on the paper and fiber but also in the manufacture of electronic components, for example, a printed substrate and an LCD panel.

As a result, the ink-jet printing technology for an electronic component, which requires more accurate and precise discharge of functional ink than the conventional graphic printing, requires functions that have not been required for the conventional ink-jet head. Besides the basic requirement for the reduced size of the discharged ink droplet and reduced ink droplet speed variation, high density nozzles and high-frequency properties are required. In order to satisfy such requirement, thinner actuators of the ink-jet head needed to be developed.

FIG. 1 is a front cross-sectional view showing an ink-jet head 12 according to a conventional technology. As shown in FIG. 1, in the past, after bonding a piezoelectric member to one surface of the ink-jet head, a dicing process was performed in order to actuate the piezoelectric member as an independent actuator 2 on each chamber 6.

Here, if each actuator 2 is severed completely, a body of the ink-jet head as well as a membrane 5 may be seriously stressed. If not severed completely due to such a problem, as shown in FIG. 1, the lower part of the piezoelectric member is not completely separated and there remains a residual 3. As a result, adjacent actuators 2 are linked with one another, causing crosstalk.

Moreover, if the dicing process is performed twice by using a thin saw blade due to the consideration of stress on the silicon body of the ink-jet head, there remains a wall-shaped residual 8 of the piezoelectric member between adjacent actuators, causing crosstalk.

SUMMARY

The present invention provides an ink-jet head and a manufacturing method thereof that can reduce crosstalk and buffer a stress generated when dividing a piezoelectric member.

An aspect of the present invention features a method of manufacturing an ink-jet head, which includes a plurality of chambers, a membrane covering the plurality of chambers, and a plurality of actuators separated from one another by a virtual dividing line on the membrane such that pressure is applied to each of the plurality of chambers. The method in accordance with an embodiment of the present invention can include: forming a groove at a position on one surface of the membrane, the position corresponding to the position of the dividing line; bonding a piezoelectric member to the one surface of the membrane having the groove formed therein by using adhesive resin; and dividing the piezoelectric member such that the groove is exposed.

The groove can be formed by chemical etching, and the adhesive resin can be filled in the groove.

Another aspect of the present invention features an ink-jet head. The ink-jet head in accordance with an embodiment of the present invention can include: a plurality of chambers; a membrane covering the plurality of chambers; and a plurality of piezoelectric members separated from one another by a virtual dividing line and bonded to the membrane such that pressure is applied to each of the plurality of chambers. A groove can be formed at a position on one surface of the membrane, the position corresponding to the position of the dividing line, and the groove can be filled with adhesive resin.

DETAILED DESCRIPTION

Figure 1:
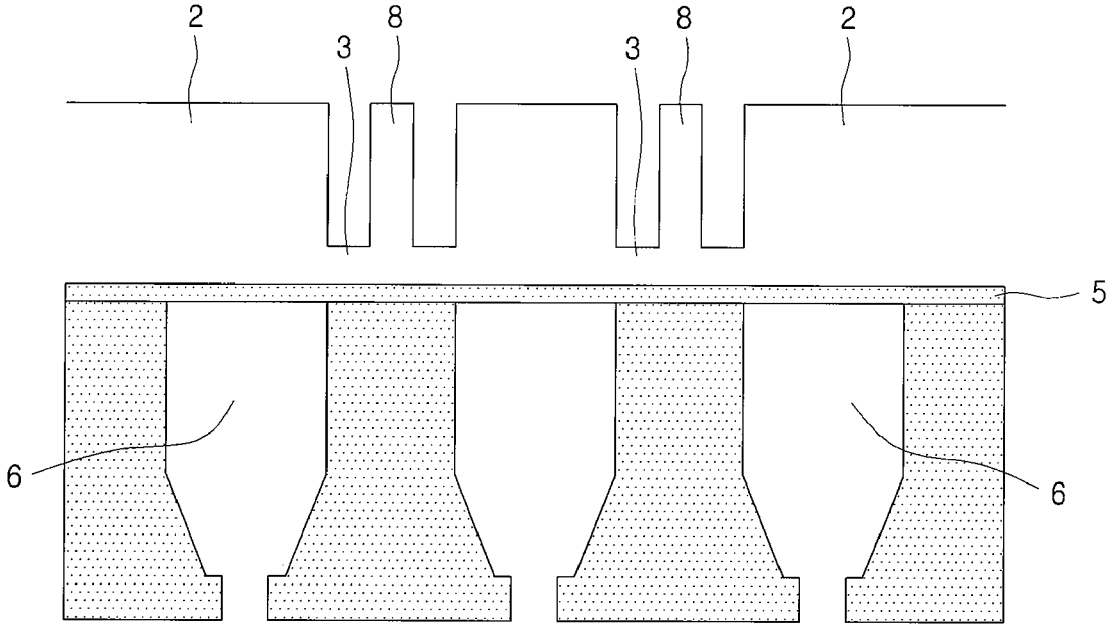
FIG. 1 is a front cross-sectional view showing an ink-jet head according to a conventional technology.

As the present invention can have various embodiments and can be diversely changed, a specific embodiment will be illustrated in the drawings and described in detail. While the present invention is not limited to the particular embodiment, all modification, equivalents and substitutes included in the spirit and scope of the present invention are understood to be included therein.

Hereinafter, a certain embodiment of a method of manufacturing an ink-jet head in accordance with the present invention will be described in detail with reference to the accompanying drawings. In description with reference to accompanying drawings, the same reference numerals will be assigned to the same or corresponding elements, and redundant descriptions thereof will be omitted.

Figure 2:
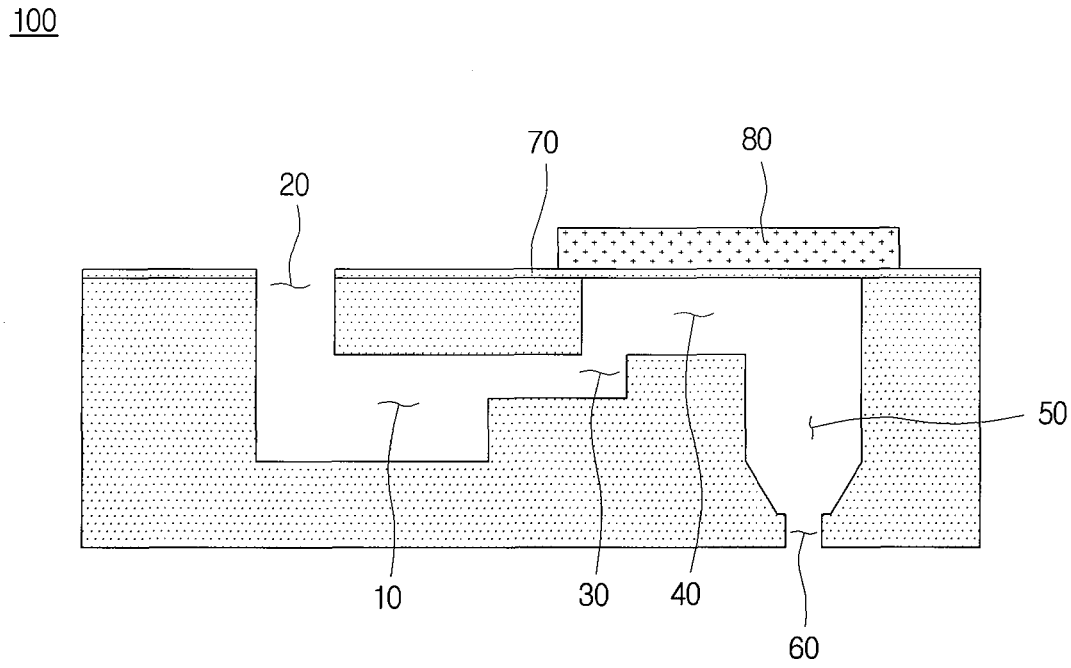
FIG. 2 is a cross-sectional view of a side of an ink-jet head according to an embodiment of the present invention.

Before describing a method of manufacturing an ink-jet head in accordance with an embodiment of the present invention, each element of a piezoelectric type ink-jet head will be schematically described with reference to FIG. 2, which is a cross-sectional view of a side of an ink-jet head manufactured according to an embodiment of the present invention. Shown in FIG. 2 are a reservoir 10, an inlet port 20, a restrictor 30, a chamber 40, a damper 50, a nozzle 60, a membrane 70 and a piezoelectric member 80.

The chamber 40 accommodates ink. When the piezoelectric member 80, for example, which are formed on an upper surface of the membrane 70 applies pressure to the chamber 40, the chamber 40 transfers the accommodated ink in the direction of the nozzle 60 and causes the ink to be discharged. There can be a number of chambers, for example, 128 chambers, 256 chambers 40, etc., in parallel in one ink-jet head 100, and there can be an equal number of piezoelectric members 80 in order to provide pressure to each chamber 40. Here, each piezoelectric member 80 is arranged separately from another so that other adjacent chambers 40 are affected to a minimum. In the present specification, the space created by separation of the piezoelectric members 80 will be referred to as a dividing line.

The reservoir 10 is supplied with the ink from the outside through the inlet port 20 and stores the ink, and then provides the ink to the chamber 40 described above.

The restrictor 30 links the reservoir 10 and the chamber 40 and controls the ink flow generated between the reservoir 10 and the chamber 40. The restrictor 30 is formed to have a smaller cross sectional area than those of the reservoir 10 and the chamber 40. The restrictor 30 can control the amount of ink provided by the reservoir 10 to the chamber 40 when the membrane 70 is vibrated by the piezoelectric member 80.

The nozzle 60 is linked to the chamber 40 and is supplied with the ink from the chamber 40. Then the ink is ejected by the nozzle 60. If the vibration generated by the piezoelectric member 80 is delivered to the chamber 40 through the membrane 70, pressure is applied to the chamber 40, ejecting the ink through the nozzle 60.

The damper 50 is formed between the chamber 40 and the nozzle 60. The damper 50 can perform a function of converging the energy generated by the chamber 40 to the nozzle 60 and dampening a sudden change of pressure.

Meanwhile, an upper electrode (not shown) and a lower electrode (not shown) can be formed on the upper and lower sides of the piezoelectric member 80 in order to supply voltage to the piezoelectric member 80.

The ink-jet head 100 including the elements described above can be formed by stacking one or several substrates made of a silicon or ceramic material.

Figure 3:
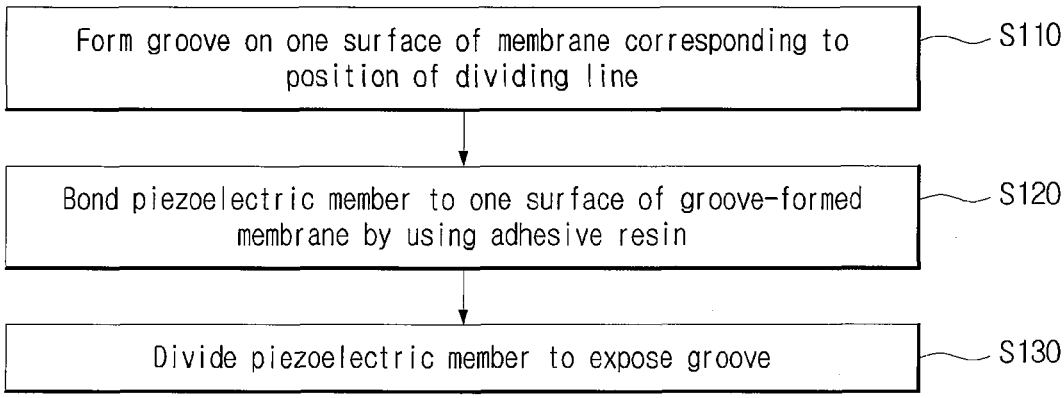
FIG. 3 is a flowchart illustrating a method of manufacturing an ink-jet head according to an embodiment of the present invention.
Figure 4:
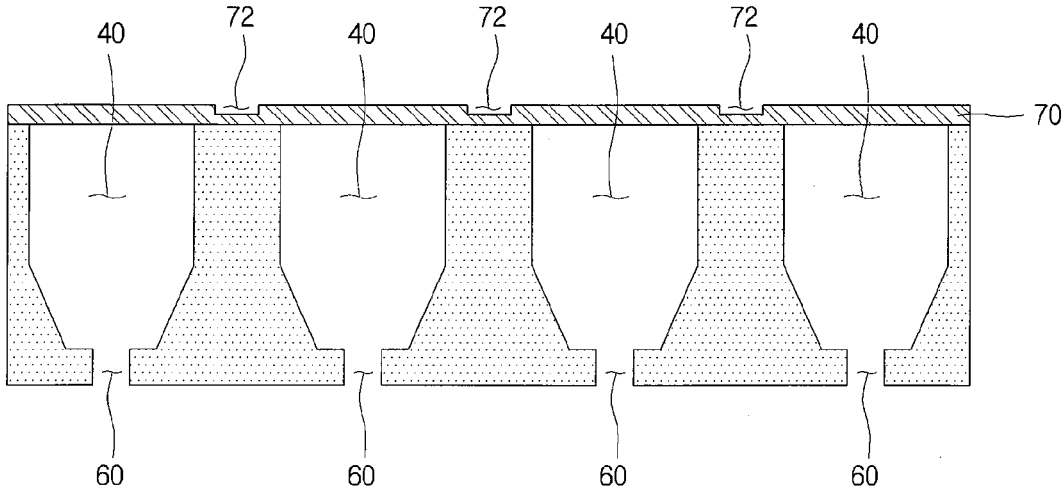
FIGS. 4 through 6 show each respective process of a method of manufacturing an ink-jet head according to an embodiment of the present invention.
Figure 5:
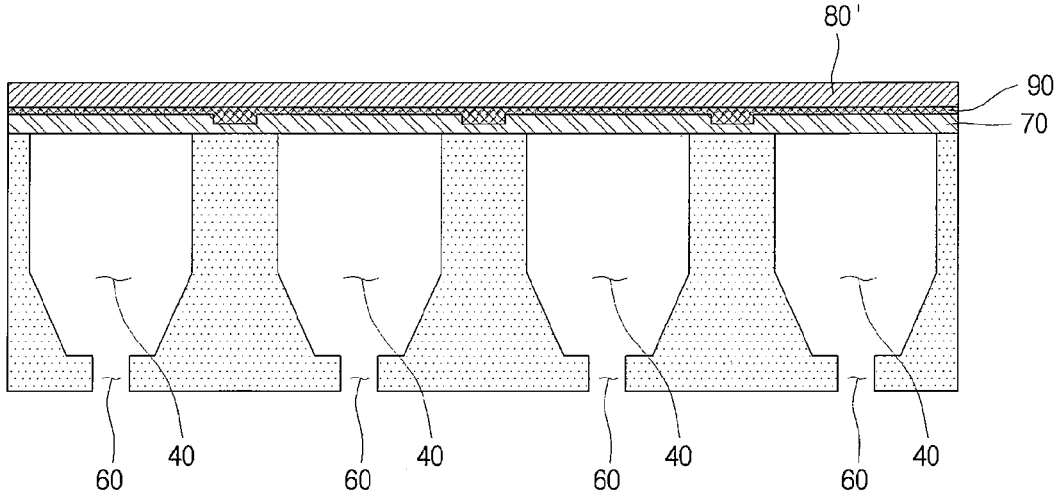
Figure 6:
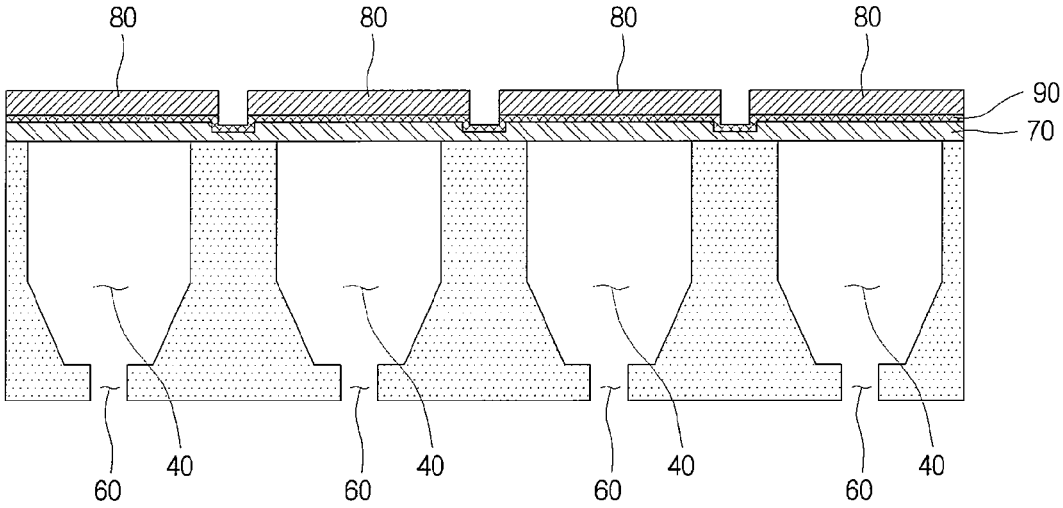

Next, a method of manufacturing an ink-jet head in accordance with an embodiment of the present invention will be described with reference to FIGS. 3 through 6. FIG. 3 is a flowchart illustrating a method of manufacturing an ink-jet head according to an embodiment of the present invention. FIGS. 4 through 6 show each respective process of a method of manufacturing an ink-jet head according to an embodiment of the present invention. Shown in FIGS. 4 through 6 are a chamber 40, a nozzle 60, a membrane 70, a groove 72, piezoelectric members 80 and 80' and adhesive resin 90.

First, the groove 72 is formed at a position of one surface of the membrane 70, the position corresponding to the position of the dividing line (S110). That is, as shown in FIG. 4, the groove 72 is formed at a position of the membrane 70, the position corresponding to a position of a boundary line which divides the membrane 70 later, that is, the dividing line. In order to form the groove 72, a chemical method, such as a wet or dry etching, can be used. If the groove 72 is formed by using the chemical method in the membrane 70 bonded to the body of the ink-jet head so as to cover the chamber 40 with the membrane 70, the stress applied to the body of the ink-jet head can be minimized, thereby improving the product reliability.

As such, after forming the groove 72 in the membrane 70, the piezoelectric member 80' is bonded using the adhesive resin 90, for example, epoxy resin, to one surface of the membrane 70 having the groove 72 formed therein (S120, FIG. 5), and then the piezoelectric member 80' is divided such that the groove 72 is exposed (S130, FIG. 6). Since the groove 72 has been formed in advance at a position of the membrane 70 corresponding to the dividing line, it is possible to completely divide the piezoelectric member 80' by use of a saw blade and the like.

Besides, if the adhesive resin 90 is coated to be filled inside the groove 72 during the process of bonding the piezoelectric member 80', the adhesive resin 90 filled inside the groove 72 can function as a buffer, reducing the stress applied to the membrane 70 and the body of the ink-jet head.

In addition, as shown in FIG. 6, the adhesive resin 90 may remain inside the groove 72 formed in the membrane 70 even after dividing the piezoelectric member. The adhesive resin remaining inside the groove 72 can improve the bonding force between the piezoelectric member 80 and the membrane 70, and thus can enhance the product reliability.

While the present invention has been described with reference to a certain embodiment thereof, it will be understood by those skilled in the art that various changes and modification in forms and details may be made without departing from the spirit and scope of the present invention as defined by the appended claims.

Numerous embodiments other than the embodiment described above are included within the scope of the present invention.

What is claimed is:

1. A method of manufacturing an ink-jet head including a plurality of chambers, a membrane covering the plurality of chambers, and a plurality of actuators separated from one another by a virtual dividing line on the membrane such that pressure is applied to each of the plurality of chambers, the method comprising:

forming a groove at a position on one surface of the membrane, the position corresponding to the position of the dividing line;

coating adhesive resin on the one surface of the membrane having the groove formed therein such that the groove is filled in and bonding a piezoelectric member; and dividing the piezoelectric member such that the groove is exposed by cutting the piezoelectric member along the dividing line.

2. The method of claim 1, wherein the forming of the groove is performed by chemical etching.

* * * * *